US006302730B1

(12) United States Patent
Pill et al.

(10) Patent No.: US 6,302,730 B1
(45) Date of Patent: Oct. 16, 2001

(54) ELECTRICAL TERMINAL MODULE FOR RECEIVING AN EDGE OF A PRINTED CIRCUIT BOARD

(75) Inventors: Anthony J. Pill, Aurora; Bill Blake Wilson, Montgomery; Lawrence E. Geib, Bartlett, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/663,890

(22) Filed: Sep. 18, 2000

(51) Int. Cl.[7] ..... H01R 13/60

(52) U.S. Cl. ..... 439/534; 439/630; 439/8; 439/260; 439/733.1

(58) Field of Search ..... 439/534, 6, 8, 439/73, 3.1, 34, 660, 630, 59, 62, 260; 359/843, 874, 877

(56) References Cited

U.S. PATENT DOCUMENTS 5,154,644 * 10/1992 Kiat-Hup et al. ..... 439/630

6,064,195 * 5/2000 Clayton et al. ..... 439/8

* cited by examiner

*Primary Examiner*—Tho D. Ta
(74) *Attorney, Agent, or Firm*—Stacey E. Caldwell

(57) ABSTRACT

A terminal module is provided for coupling between a printed circuit board and a relatively movable component. The module includes an elongated dielectric housing defining a longitudinal axis extending between opposite ends of the housing. One opposite end of the housing has a coupling for interengagement with the relatively movable component and for allowing relative movement between the component and the printed circuit board. A slot extends axially into the housing from an open end thereof at an opposite end of the housing for embracing an edge of a printed circuit board inserted axially into the slot. A conductive terminal is mounted on the housing through an open side of the housing generally parallel to the slot. The terminal has a contact portion extending into the slot for engaging an appropriate circuit trace on the printed circuit board.

11 Claims, 3 Drawing Sheets

ELECTRICAL TERMINAL MODULE FOR RECEIVING AN EDGE OF A PRINTED CIRCUIT BOARD

FIELD OF THE INVENTION

This invention generally relates to the art of electrical connections and, particularly, to an electrical terminal module for coupling between a printed circuit board and a relatively movable component, such as a motor for a remotely controlled mirror in a vehicle.

BACKGROUND OF THE INVENTION

There are various applications wherein a relatively movable component is operatively associated with a printed circuit board and whereby the particular position of the component effects functions through the printed circuit board. For instance, in automotive or vehicular applications, rear view mirrors often are remotely controlled by actuators positioned at various locations in the vehicle, such as on a driver-side door. A driver operates the actuator at its remote location to adjust the rear view mirror.

One of the problems with vehicular mirror systems as described above is that different drivers most often must adjust the mirror for a particular driver's anatomical height or posture. This process becomes rather frustrating when multiple drivers repeatedly use the same vehicle. The mirror adjustment process is a constant burden. Consequently, systems have been designed whereby a particular position of the mirror is retained in a memory, and a particular driver simply must deliver a code to the system whereupon the mirror is automatically reset to a position corresponding to that driver's code.

One of the operative components of the system for automatically resetting a vehicular mirror is a terminal module which is mechanically coupled between a motor for the remotely controlled mirror and a printed circuit board. The module is mechanically coupled to the motor for movement therewith. The module embraces a printed circuit board and has a terminal for engaging a conductor on the circuit board. The module moves relative to the circuit board, and the terminal slides on the conductor to provide a variable resistor. The resistance between the printed circuit board conductor and the terminal on the module establishes a resistance reading which can be saved in memory and retrieved by a particular driver whereupon the system automatically adjusts the mirror to a position corresponding to the saved resistance reading.

Such terminal modules as described above must be manufactured in considerable volume. Unfortunately, the modules heretofore have been relatively expensive because of the molding process involved. Specifically, the terminal module includes a molded plastic housing mounting the terminal which slides along the printed circuit board. Not only must the housing mount the terminal, but the housing must include a slot for embracing the printed circuit board, typically at an edge thereof. The housing further must include some sort of universal joint or other coupling means to provide relative movement between the module and the motor for the remotely controlled mirror. All of these components or functions of the module must be accomplished in a very small molded part which often requires complex and expensive molding dies having various side cores. The present invention is directed to providing a terminal module of the character described, wherein the module housing is very simple and inexpensive and can be molded by simple separable molding die halves, with the terminal of the module simply assembled in the same slot which receives the printed circuit board.

SUMMARY OF THE INVENTION

An object, therefore, of the invention is to provide a new and improved terminal module for coupling between a printed circuit board and a relatively movable component.

Another object of the invention is to provide a new and improved terminal module for coupling between a motor for a remotely controlled mirror in a vehicle and a printed circuit board.

In the exemplary embodiment of the invention, the terminal module includes an elongated dielectric housing defining a longitudinal axis extending between opposite ends of the housing. One opposite end of the housing has coupling means for interengagement with the relatively movable component and for allowing relative movement between the component and the printed circuit board. A slot extends axially into the housing from an open end thereof at an opposite end of the housing for embracing an edge of a printed circuit board inserted axially into the slot. A conductive terminal is mounted onto the housing through an open side of the housing generally parallel to the slot. The terminal has a contact portion extending into the slot for engaging an appropriate circuit trace on the printed circuit board.

As disclosed herein, the relatively movable component may be a motor for a remotely controlled mirror in a vehicle, and the coupling means on the housing of the terminal module comprises a universal joint in the form of a ball for receipt in an appropriate receptacle of the mirror motor.

Complementary interengaging latch means are provided between the terminal and the housing for locking the terminal to the housing. In the exemplary embodiment, the latch means include a resilient latch member on the terminal automatically engageable with a latch shoulder on the housing in response to mounting the terminal on the housing.

The housing of the terminal module also includes a terminal receptacle for receiving the terminal inserted thereinto in a direction generally parallel to a planar orientation of the printed circuit board inserted into the slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 2:
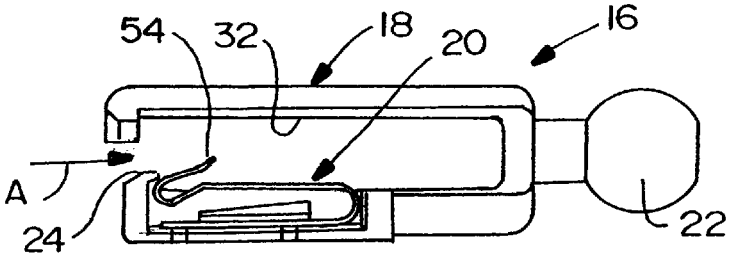
FIG. 2 is a side elevational view of the module.
Figure 3:
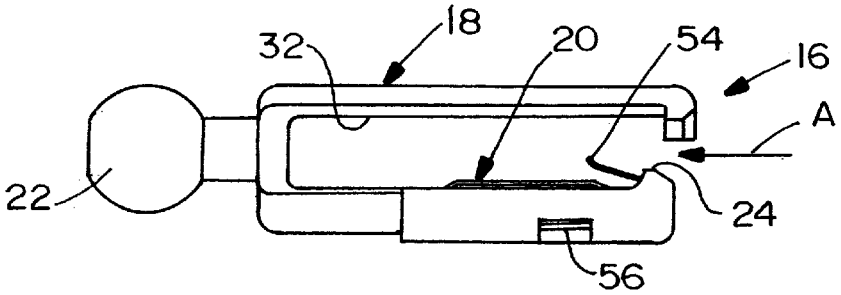
FIG. 3 is a side elevational view of the module looking at the opposite side of FIG. 2.

Referring to the drawings in greater detail, and first to FIGS. 1–5, the invention is embodied in a terminal module, generally designated 16, which includes two elements, namely a dielectric housing, generally designated 18, and a terminal, generally designated 20. Dielectric housing 18 is a one-piece component molded of plastic material or the like. Terminal 20 is a one-piece component stamped and formed of conductive sheet metal material or the like. As will be described in greater detail hereinafter, a coupling means in the form of a ball-type universal joint 22 is located at one end of the module. The module is designed for receiving a printed circuit board inserted through a mouth 24 at the opposite end of the housing in the direction of arrows "A" (FIGS. 2 and 3).

Referring to FIGS. 6–10 in conjunction with FIGS. 1–5, dielectric housing 18 includes ball 22 and mouth 24 at opposite ends thereof as described above. The housing is an elongated structure and defines a longitudinal axis 26 (FIGS. 7 and 8) extending between and through ball 22 and mouth 24. The housing has a top wall 28 and a bottom wall 30 defining a printed circuit board-receiving slot 32 therebetween. The slot communicates with mouth 24 so that an edge of the printed circuit board can be inserted through the mouth in the direction of arrows "A" and into slot 32.

At this point it should be understood that such terms as "top", "bottom" and the like herein are used simply to provide a clear and concise understanding of the invention in the context of the orientation of the various components in the drawings. Terminal module 16 obviously is omnidirectional in actual use, and these terms are not in any way to be construed as limiting, other than assisting in a description of the module in the drawings.

Figure 6:
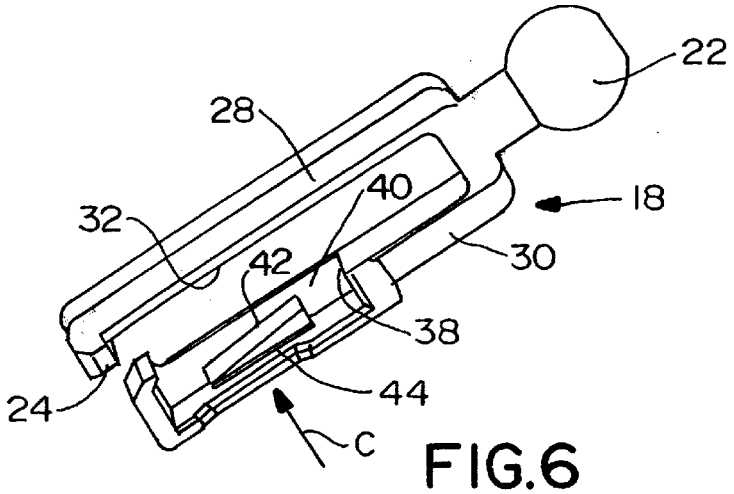
FIGS. 6–10 are views corresponding to FIGS. 1–5, respectively, but showing only the housing of the module, with the terminal removed.
Figure 10:
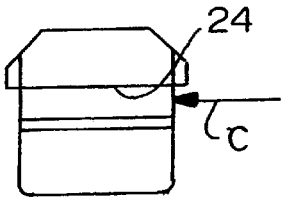
Figure 7:
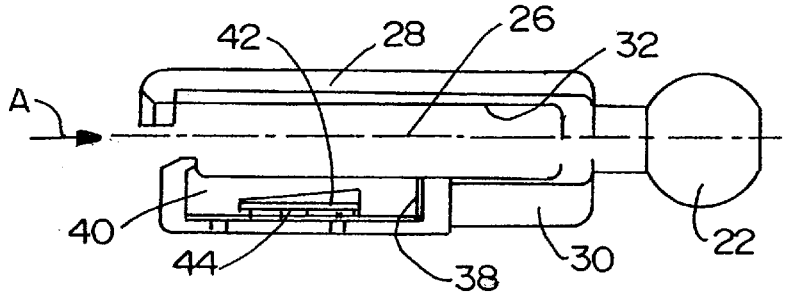
Figure 8:
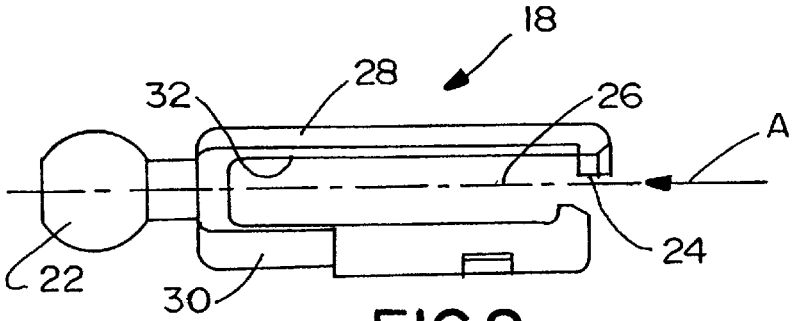
Figure 9:
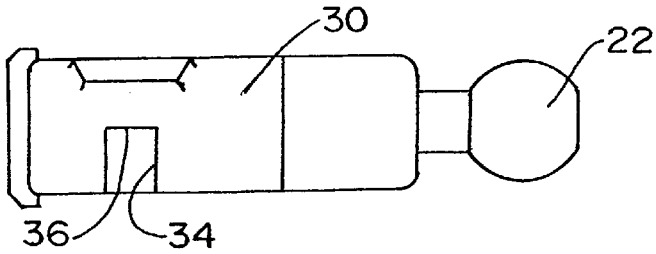
Figure 11:
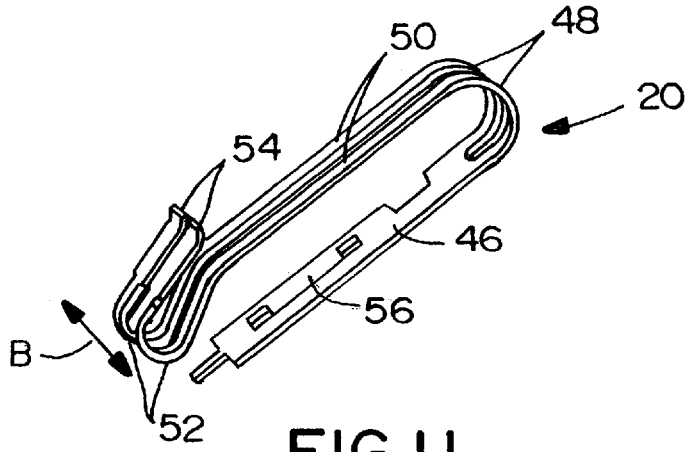
FIG. 11 is a perspective view of the terminal of the module.

With that understanding, bottom wall 30 of housing 18 has a generally rectangular hole 34 as best seen in FIG. 9. The hole defines a latch shoulder 36. As best seen in FIGS. 6 and 7, bottom wall 30 also has a recessed area 38 in the top thereof facing into slot 32 and outwardly at an edge of the bottom wall. A back side of recessed area 38 is bounded by an abutment wall 40. A retention flange 42 projects forwardly into recessed area 38 from abutment wall 40. A narrow slot 44 is defined beneath retention flange 42.

Figure 14:
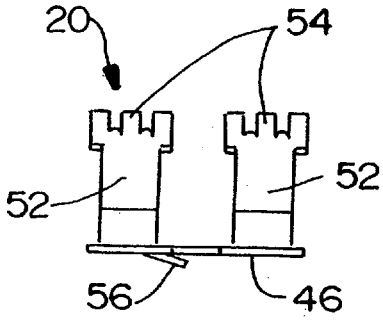
FIG. 14 is an end elevational view of the terminal.
Figure 12:
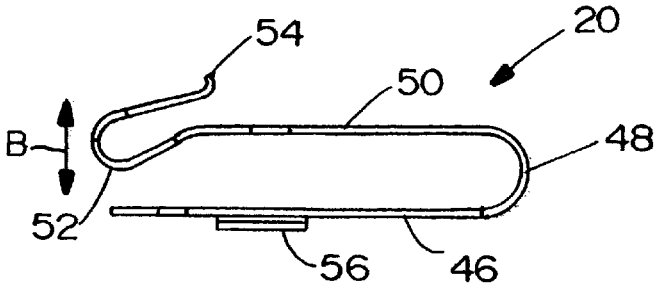
FIG. 12 is a side elevational view of the terminal.
Figure 13:
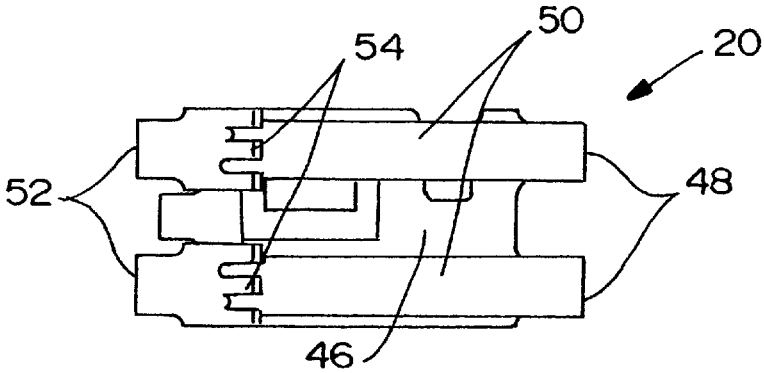
FIG. 13 is a top plan view of the terminal.

Referring to FIGS. 11–14, terminal 20 is generally U-shaped to define a base portion 46 joined at elbow portions 48 to a pair of cantilevered contact arms 50 folded back over the top of base portion 46. Contact arms 50 have U-shaped portions 52 at the distal ends of the arms, with the U-shaped portions terminating in toothed contact ends 54 projecting upwardly of cantilevered contact arms 50. A latch tab 56 is stamped out of base portion 46 and is bent downwardly from the base portion as best seen in FIG. 14. As will be understood in greater detail below, when terminal 20 is mounted on housing 18, cantilevered contact arms 50 and contact portions 54 are flexible in the direction of double-headed arrows "B".

Figure 1:
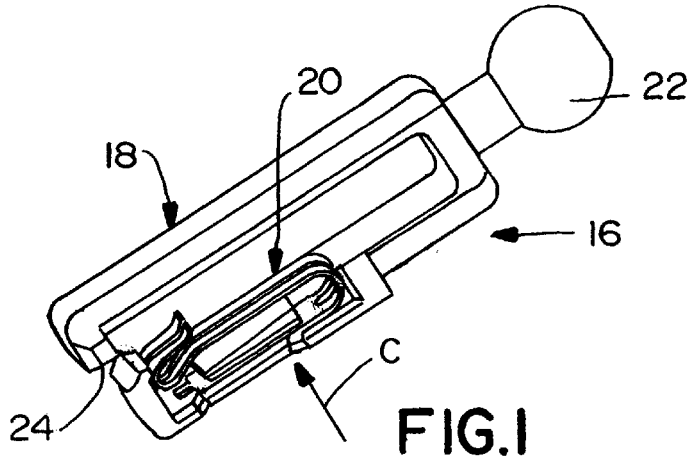
FIG. 1 is a perspective view of a terminal module incorporating the concepts of the invention.
Figure 5:
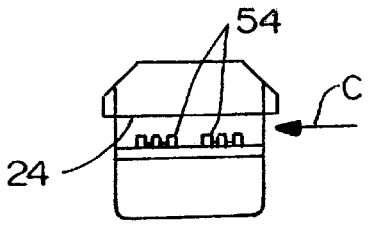
FIG. 5 is an end elevational view of the module.
Figure 4:
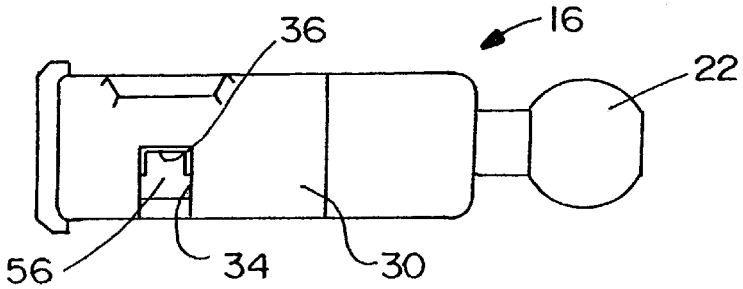
FIG. 4 is a bottom plan view of the module according to the orientation of FIG. 1.

Terminal 20 is assembled to housing 18 in the direction of arrows "C" (FIGS. 1, 5, 6 and 10). In essence, the terminal is assembled by inserting the terminal in the direction of arrows "C" into recessed area 38 in bottom wall 30 of the housing. During insertion, base portion 46 of the terminal moves into narrow slot 44 beneath retention flange 42. The terminal is inserted until the base portion abuts against abutment wall 40 at the back of the recessed area. When the terminal is so fully inserted, latch tab 56 of the terminal snaps behind latch shoulder 36 (FIG. 9) on bottom wall 30 of the housing, as can be seen in FIG. 4. The terminal then is rigidly fixed to the housing. As best seen in FIGS. 2 and 5, when the terminal is mounted and fixed to the housing, contact portions 54 project upwardly into mouth 24 and slot 32. Therefore, when the printed circuit board is inserted into the module in the direction of arrows "A", contact portions 54 will engage the appropriate circuit traces or conductors on the printed circuit board. With the edge of the circuit board in the slot of the module, the module can move relative to the board, and contact portions 54 can slide over the circuit traces or conductors on the board. Simultaneously, the module can pivot or move universally relative to another movable component, such as a remotely controlled mirror motor, through the coupling means provided by ball 22.

From the foregoing, it can be understood that recessed area 38, retention flange 42 and slot 44 define a receptacle means for receiving terminal 20 inserted thereinto in a direction (arrows "C") generally parallel to the planar orientation of the printed circuit board which is inserted in the direction of arrows "A" through mouth 24 into slot 32. With this structural combination, it can also be understood that mouth 24, slot 32, recessed area 38, abutment wall 40, retention flange 42 and narrow slot 44, along with top wall 28, bottom wall 30 and ball 22, all can be molded by a simple two-part separable molding die. This significantly reduces the costs of manufacturing housing 18 and, therefore, terminal module 16, particularly in mass production environments such as automobiles or other vehicles.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A terminal module for coupling between a motor for a remotely controlled mirror in a vehicle and a printed circuit board, comprising:

an elongated dielectric housing defining a longitudinal axis extending between opposite ends of the housing and the housing having opposite open sides extending generally parallel to said axis, one opposite end of the housing having a universal joint for coupling to the mirror motor and allowing relative universal movement between the mirror motor and the housing and the other opposite end of the housing being open, a slot extending into the housing generally parallel to said axis from said open end thereof for embracing an edge of said printed circuit board inserted into the slot; and a conductive terminal mounted onto the housing through one of the open sides of the housing generally parallel to the slot, the terminal having a contact portion extending into the slot for engaging an appropriate circuit trace on the printed circuit board.

2. The terminal module of claim 1 wherein said universal joint comprises a ball for receipt in an appropriate receptacle of the mirror motor.

3. The terminal module of claim 1 wherein said housing includes terminal receptacle means for receiving the terminal inserted thereinto in a direction generally parallel to a planar orientation of the printed circuit board inserted into the slot.

4. The terminal module of claim 1, including complementary interengaging latch means between the terminal and the housing for locking the terminal to the housing.

5. The terminal module of claim 4 wherein said complementary interengaging latch means include a resilient latch member on the terminal automatically engageable with a latch shoulder on the housing in response to mounting the terminal on the housing.

6. A terminal module for coupling between a motor for a remotely controlled mirror in a vehicle and a printed circuit board, comprising:

an elongated dielectric housing defining a longitudinal axis extending between opposite ends of the housing and the housing having opposite open sides extending generally parallel to said axis, one opposite end of the housing having a ball for coupling to the mirror motor and allowing relative universal movement between the mirror motor and the housing and the other opposite end of the housing being open, a slot extending into the housing generally parallel to said axis from said open end thereof for embracing an edge of said printed circuit board inserted into the slot;

a conductive terminal mounted onto the housing through one of the open sides of the housing generally parallel to the slot, the terminal having a contact portion extending into the slot for engaging an appropriate circuit trace on the printed circuit board;

receptacle means on the housing for receiving the terminal inserted thereinto in a direction generally parallel to a planar orientation of the printed circuit board inserted into the slot; and a resilient latch member on the terminal automatically engageable with a latch shoulder on the housing in response to mounting the terminal on the housing.

7. A terminal module for coupling between a printed circuit board and a relatively movable component, comprising:

an elongated dielectric housing defining a longitudinal axis extending between opposite ends of the housing and the housing having opposite open sides extending generally parallel to said axis, one opposite end of the housing having a coupling means for interengagement with said relatively movable component and for allowing relative movement between the component and the printed circuit board and the other opposite end of the housing being open, a slot extending into the housing generally parallel to said axis from said open end thereof for embracing an edge of said printed circuit board inserted into the slot; and a conductive terminal mounted onto the housing through one of the open sides of the housing generally parallel to the slot, the terminal having a contact portion extending into the slot for engaging an appropriate circuit trace on the printed circuit board.

8. The terminal module of claim 7 wherein said coupling means comprises a ball.

9. The terminal module of claim 7 wherein said housing includes terminal receptacle means for receiving the terminal inserted thereinto in a direction generally parallel to a planar orientation of the printed circuit board inserted into the slot.

10. The terminal module of claim 7, including complementary interengaging latch means between the terminal and the housing for locking the terminal to the housing.

11. The terminal module of claim 10 wherein said complementary interengaging latch means include a resilient latch member on the terminal automatically engageable with a latch shoulder on the housing in response to mounting the terminal on the housing.

* * * * *